US011155406B2

(12) United States Patent
Lavigne

(10) Patent No.: US 11,155,406 B2
(45) Date of Patent: Oct. 26, 2021

(54) HANDS-FREE LID OPENER

(71) Applicant: Kim Cyril John Lavigne, Baroda, MI (US)

(72) Inventor: Kim Cyril John Lavigne, Baroda, MI (US)

(73) Assignee: Something From Nothing LLC, Baroda, MI (US)

( * ) Notice: Subject to any disclaimer, the term of this patent is extended or adjusted under 35 U.S.C. 154(b) by 65 days.

(21) Appl. No.: 16/572,901

(22) Filed: Sep. 17, 2019

(65) Prior Publication Data

US 2021/0078798 A1 Mar. 18, 2021

(51) Int. Cl.

*B65D 43/26* (2006.01)
*B65F 1/16* (2006.01)
*B65F 1/14* (2006.01)

(52) U.S. Cl.

CPC ..... *B65F 1/163* (2013.01); *B65F 1/1421* (2013.01)

(58) Field of Classification Search

CPC ..... B65F 1/163; B65F 1/1421; B65D 43/26; B65D 43/262
USPC ..... 248/907, 147; 220/262, 263, 908
See application file for complete search history.

(56) References Cited

U.S. PATENT DOCUMENTS 1,131,774 A 3/1915 Davis
1,218,632 A 3/1917 Derry
1,247,058 A 11/1917 Zirferer
1,704,906 A 3/1929 Trick
4,303,174 A * 12/1981 Anderson ..... B65F 1/163 206/515
5,195,649 A 3/1993 Wolters
5,230,525 A 7/1993 Delmerico et al.
6,024,238 A 2/2000 Jaros
6,039,200 A 3/2000 Armor
7,070,064 B1 * 7/2006 Henry ..... B65F 1/1623 220/262
8,439,218 B1 5/2013 Watts
9,284,117 B2 3/2016 Guild
9,409,708 B1 8/2016 Watts
2008/0105680 A1 5/2008 Carter et al.
2009/0250463 A1 10/2009 Van Risseghem et al.
2009/0321449 A1 12/2009 Arthurson
2011/0174292 A1 7/2011 Richards
2013/0134167 A1 5/2013 Burleson

FOREIGN PATENT DOCUMENTS

DE 102016003698 * 9/2017 ..... B65F 1/16
GB 2445534 7/2008
WO WO2018029510 * 2/2018 ..... B65F 1/08

* cited by examiner

*Primary Examiner* — James N Smalley
*Assistant Examiner* — Elizabeth J Volz
(74) *Attorney, Agent, or Firm* — Brian M. Holt

(57) ABSTRACT

A lid opener for interconnection with a waste container with a handle and a lid the lid opener is provided with a lever dimensioned to pivotally couple with the handle. The lid opener is further provided with a cord coupled with a force portion of the lever. A load portion of the lever is dimensioned to extend underneath the lid, whereby downward force applied to the cord causes the lever to pivot about the handle and open the lid.

17 Claims, 12 Drawing Sheets

HANDS-FREE LID OPENER

BACKGROUND

Field of the Invention

This invention relates to a lid opener. More particularly, the invention relates to a lid opener capable of opening the lid of a waste container without the use of hands.

Description of Related Art

A variety of similarly shaped and functioning containers are available for temporary storage and disposal of waste. Curbside waste containers, in particular, have been, to a significant extent, standardized. Typical curbside waste containers are similar in shape and size. Curbside waste containers generally have a lid that is attached to a handle on the top back of the waste container. It is also common for curbside waste containers to be designed so as to be easily lifted by a robotic arm of a waste disposal vehicle.

Be that as it may, it is often awkward, or even difficult, to open the lid of waste containers with one's hands. For example, it is difficult to open the lid of a waste container while encumbered by bags or articles of trash. It is not uncommon to find it necessary to set items on the ground, or to shift items between hands, in order to lift the lid of a waste container. Furthermore, the lid of waste containers often fall backwards easily, slamming against the back of the waste container. Conventional solutions tend to be bulky and complex. Many solutions involve encasement of the waste container, to one degree or another, within a frame or docking station. This results in high costs and inconvenience in assembly, installation, and removal. Some solutions fail to restrict the tendency of the lid to flip over, necessitating additional effort to shut the lid and generating unwanted noise; while other solutions do not allow the lid to flip backwards, even if so desired. As an additional inconvenience, many standard lid openers must be removed from the waste container prior to curbside pickup. Furthermore, many lid openers are specific to a particular size or style of waste container, reducing efficiencies of scale, and consequently, increasing costs.

Therefore, it is an object of the invention to provide a lid opener and method of manufacture that overcomes deficiencies of the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

The inventor has observed that many conventional lid openers for waste containers are overly bulky and consist of too many complexly interconnected parts. The inventor has also observed that many conventional lid openers either do not restrict the tendency of the lid to flip backwards or entirely impede the lid from flipping backwards. It has further come to the attention of the inventor that many lid openers must be temporarily removed before curbside trash pickup. Moreover, the inventor has noticed that many lid openers are specifically designed for waste containers of particular sizes or styles, and thus, are not sufficiently universal. Accordingly, the inventor has recognized that it is possible to overcome these difficulties, while decreasing the costs and inconveniences associated with assembly, installation, and removal, by providing a lid opener that is less bulky, less complex, and comprises fewer components than can be found in the prior art.

Figure 10:
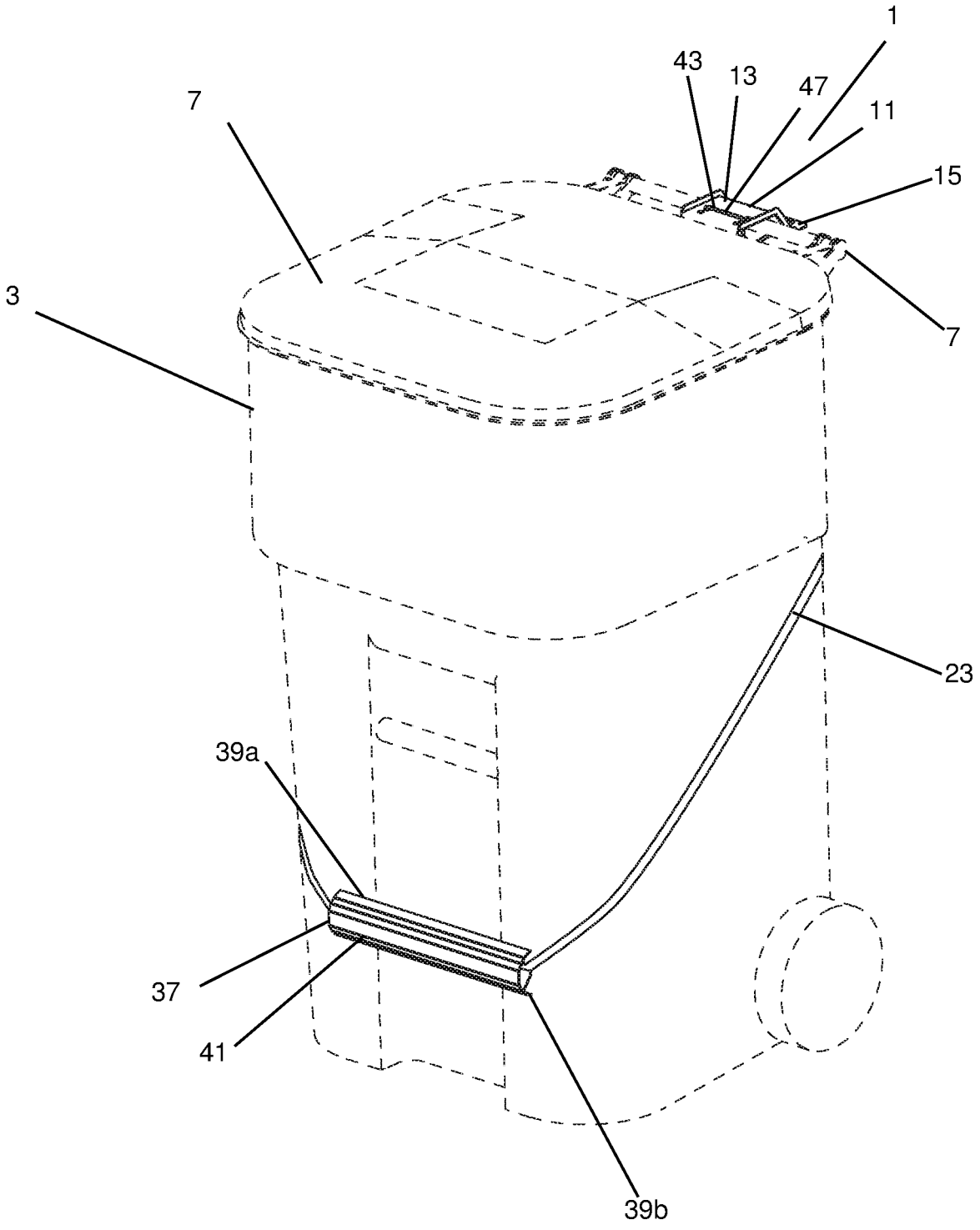
FIG. 10 is a schematic isometric view of the lid opener of FIG. 1, comprising the lever of FIG. 1 coupled with the stabilizer of FIG. 5, the brace of FIG. 6, the pedal of FIG. 4, and an exemplary cord, installed on a waste container.
Figure 11:
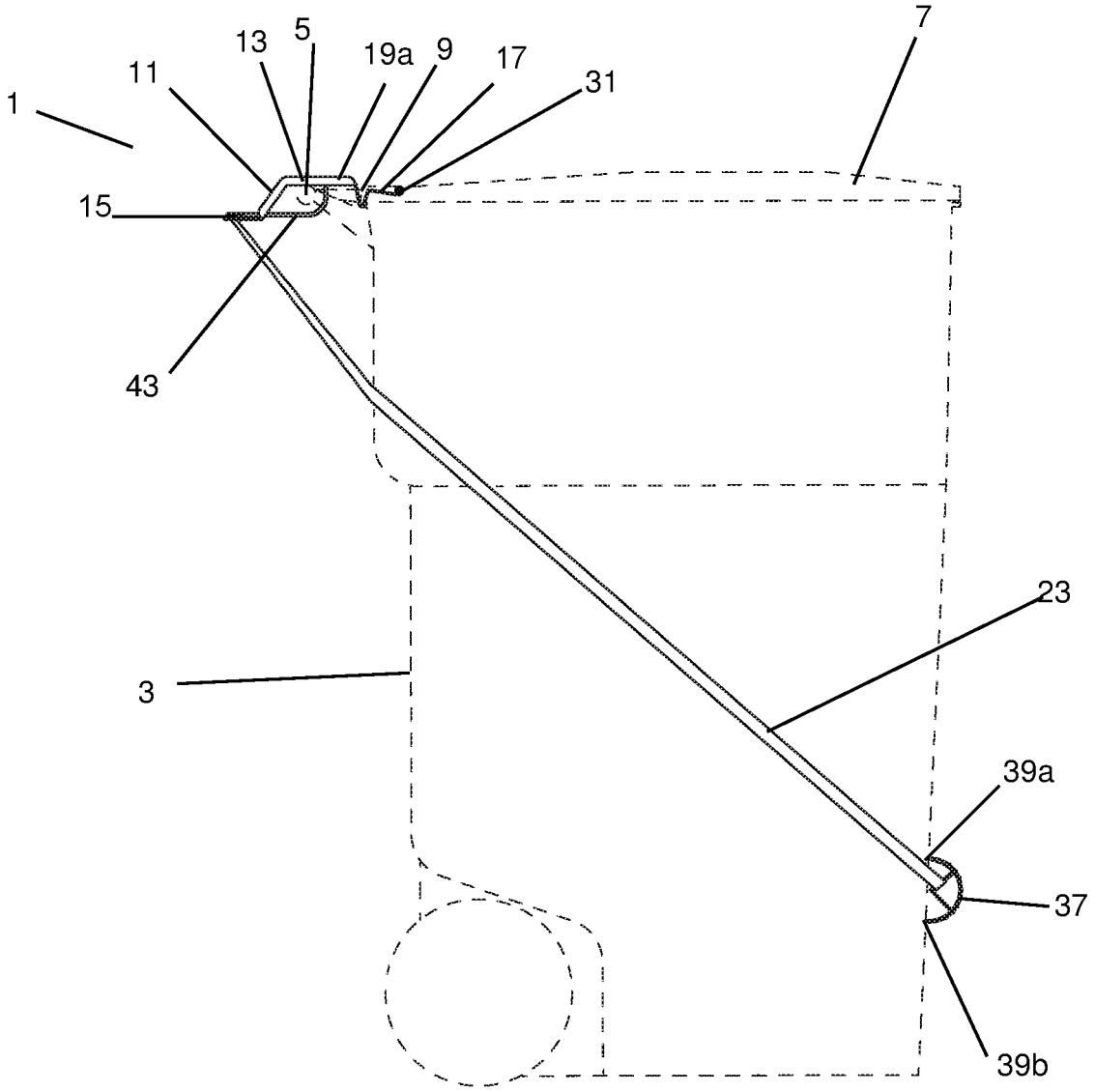
FIG. 11 is a schematic isometric side view of the lid opener of FIG. 10 installed on the waste container with a lid of the waste container opened.
Figure 12:
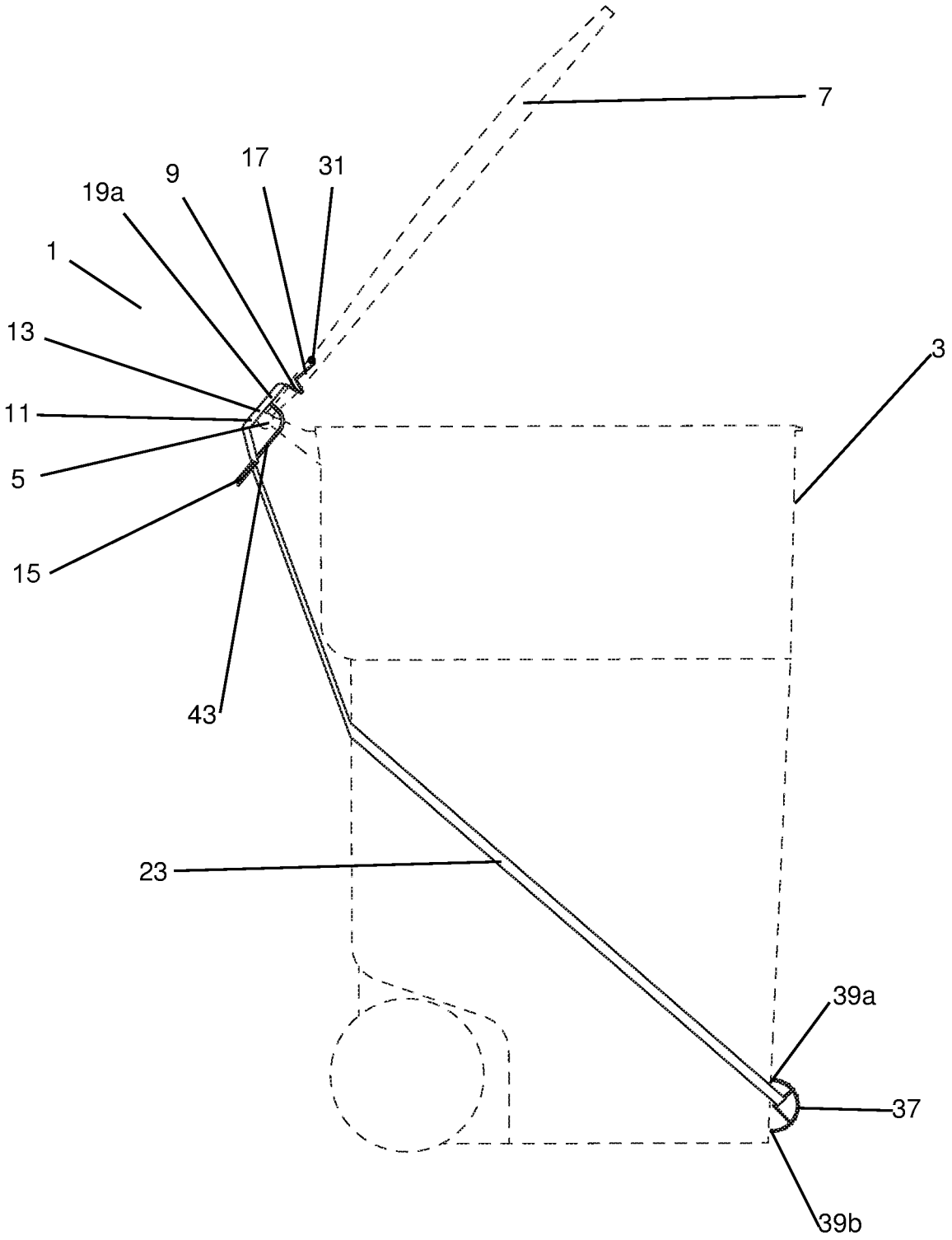
FIG. 12 is a schematic isometric side view of the lid opener of FIG. 10 installed on the waste container with the lid of the waste can closed.

An exemplary embodiment of a lid opener 1 for interconnection with a waste container 3 with a handle 5 and a lid 7 with a back edge 9 is demonstrated in FIGS. 1-12. The waste container 3, and its discrete parts, is not claimed below and is shown in FIGS. 10-12 only as an example of a typical container with which the lid opener 1 may be interconnected.

The lid opener 1 is provided with a lever 11 dimensioned to pivotally couple with the handle 5. The lever 11 is comprised of a mid portion 13, a force portion 15, and a load portion 17. When interconnected with the waste container 3, a section of the mid portion 13 of the lever 11 functions as a fulcrum, pivoting about the handle 5. The lever 11 may be made of metal, fiberglass, plastic, or other sufficiently strong and rigid material, or combination of materials. The lever 11 may be monolithic, as shown in the exemplary embodiment of FIGS. 1-3 and 7-12. The lever 11 may, alternatively, be comprised of more than one part coupled so as to achieve sufficient strength and rigidity to maintain the weight of a waste container lid.

The lever 11 may be provided with a flange 19 dimensioned longitudinally along at least a portion of each side along the length of the lever 11, adding additional strength and durability to the lever 11.

The load portion 17 of the lever 11 is dimensioned to extend underneath the lid 7 of the waste container 3. For example, as shown in the exemplary embodiment of FIGS.

1-3 and 7-12, the load portion 17 of the lever 11 may be provided with a notch 21 dimensioned to receive the back edge 9 of the lid 7, allowing the lever 11 to extend underneath the lid 7 when the lid 7 is closed. The lid opener 1 further comprises a cord 23 coupled with the force portion 15 of the lever 11, as shown in FIGS. 10-12. The cord 23 may be a cord, strip, string, rope, strand, cable, belt, chain, or any similarly functioning elongated material. The cord 23 may be made of any of a variety of materials, including, but not limited to, nylon, metal, polypropylene, or other natural or synthetic material or composite of materials. The cord 23 may be removably or fixedly coupled with the force portion 15 of the lever 11. For example, the force portion 15 of the lever 11 may be provided with an aperture 25*h* proximate a first side 27 of the lever 11 and an aperture 25*i* proximate a second side 29 of the lever 11. The ends of the cord 23 may be coupled with the force portion 15 of the lever 11 via the apertures 25 on the force portion 15 of the lever 11. The ends of the cord 23, may, for example, be tied around the apertures 25 on the force portion 15 of the lever 11. Alternatively, the cord 23 may be coupled to the apertures 25 of the force portion 15 of the lever 11 via fasteners, such as clips. Accordingly, when interconnected with the waste container 3, downward force applied to the cord 23 will cause the lever 11 to pivot about the handle 5 and open the lid 7.

The cord 23 may be dimensioned to wrap around the waste container 3 such that a foot may easily be placed upon the cord 23. Furthermore, the length of the cord 23 may be adjustable. For example, the length of the cord 23 may be adjustable from five to ten feet. The cord 23 may be made adjustable in a variety of ways. For example, the cord 23 may be coupled with a buckle. As another example, the cord 23 may be made adjustable by tying off the ends of the cord 23 around the apertures 25 on the force portion 15 of the lever 11 at different lengths.

The lid opener 1 may further comprise a stabilizer 31 coupled with the load portion 17 of the lever 11. The stabilizer 31 may be made of plastic, medal, or any other sufficiently strong and rigid material. Furthermore, the stabilizer 31 may be any of a variety of shapes and sizes. For example, the stabilizer 31 may be tubular. The stabilizer 31 may be provided with a stabilizer slit 33. The load portion 17 of the lever 11 may be provided with a load end flange 35. Accordingly, the load portion 17 of the lever 11 may be removably coupled with the stabilizer 31 by inserting the load end flange 35 into the stabilizer slit 33 of the stabilizer 31. The load portion 17 of the lever 11 may also be attached to the stabilizer 31, for example, by the use of glue or other adhesive, or by attachment via fasteners, such as screws. Alternatively, the load portion 17 of the lever 11 may be dimensioned to distribute force to the bottom of the lid 7 without the use of the stabilizer 31. For example, the load portion 17 may be provided with a flat surface dimensioned to directly contact and support the bottom of the lid 7 of the waste container 3.

Figure 1:
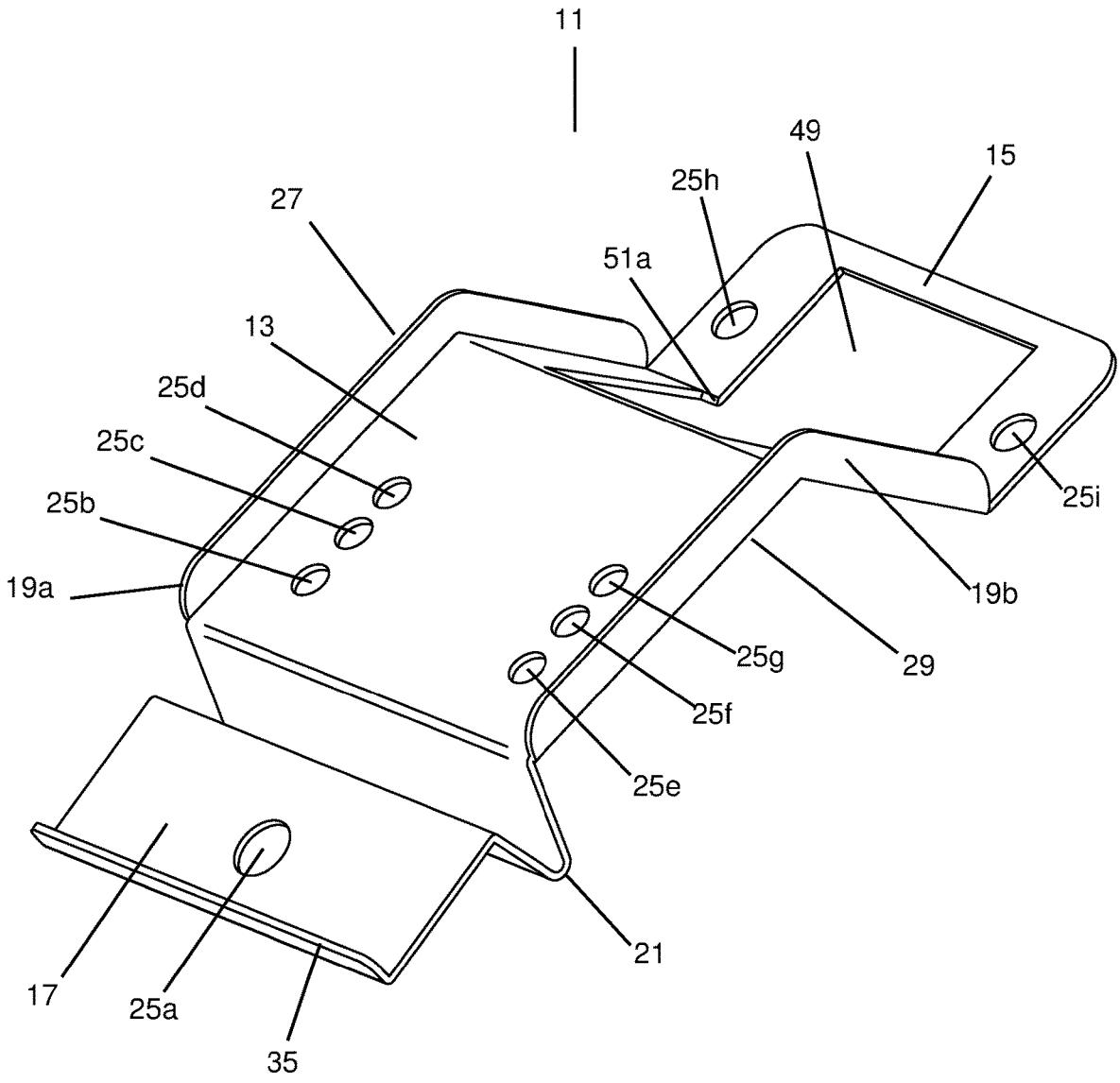
FIG. 1 is a schematic isometric angled top view of an exemplary lever for an embodiment of a lid opener.
Figure 2:
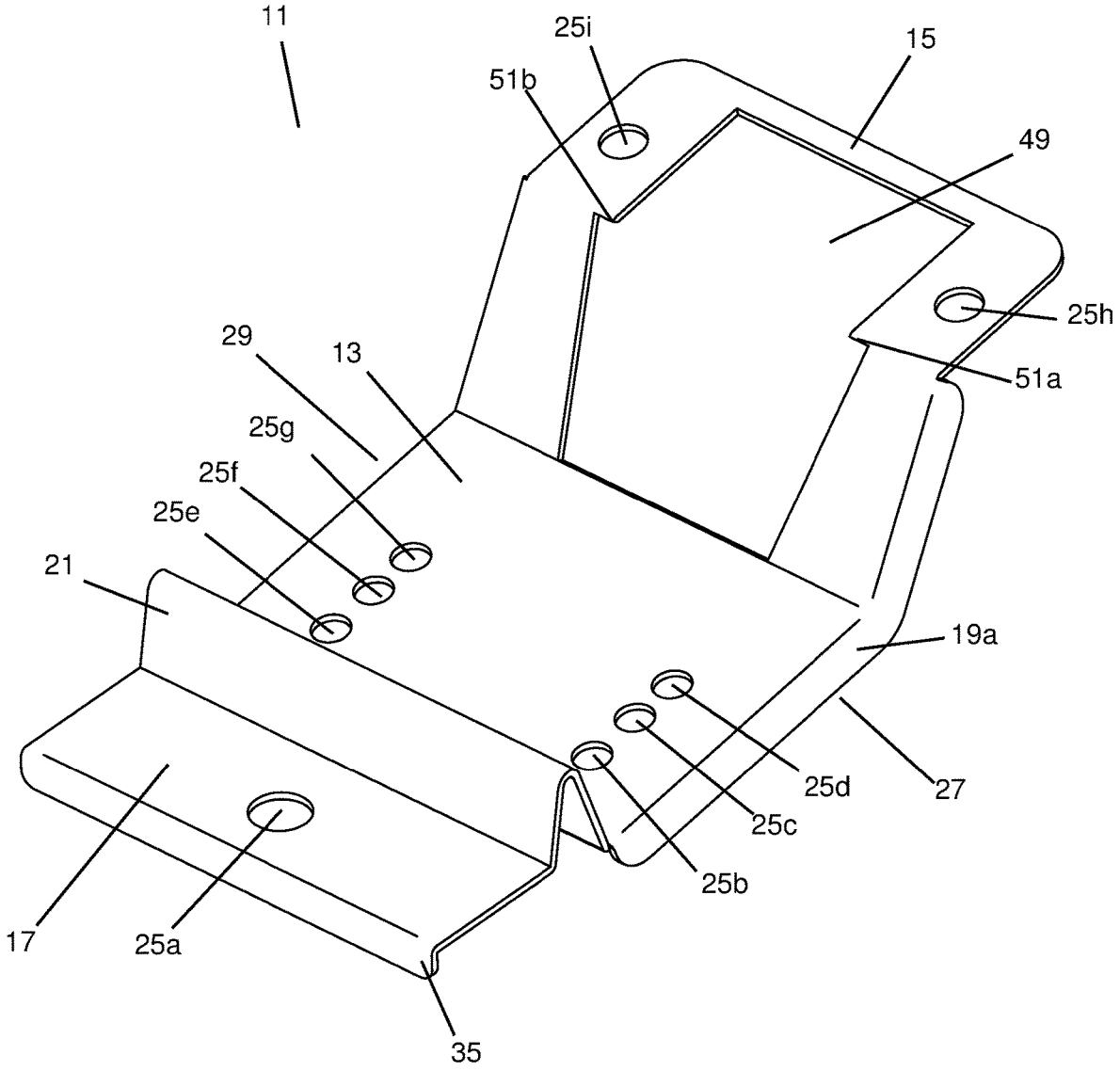
FIG. 2 is a schematic isometric angled bottom view of the lever of FIG. 1.
Figure 3:
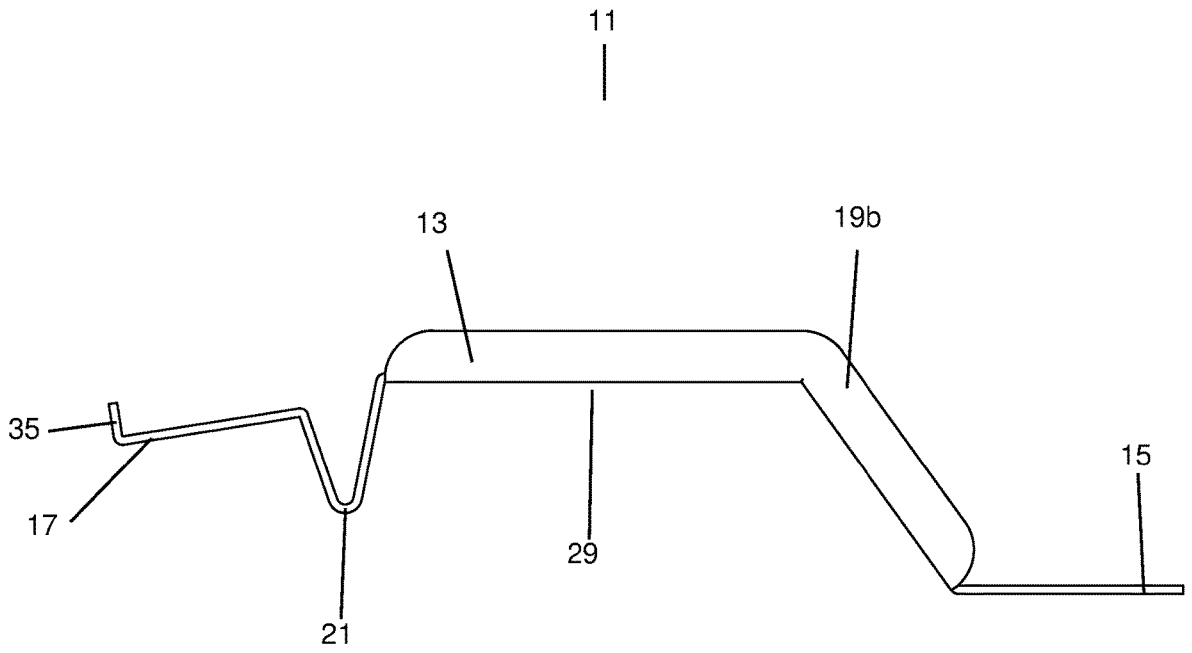
FIG. 3 is a schematic isometric side view of the lever of FIG. 1.
Figure 4:
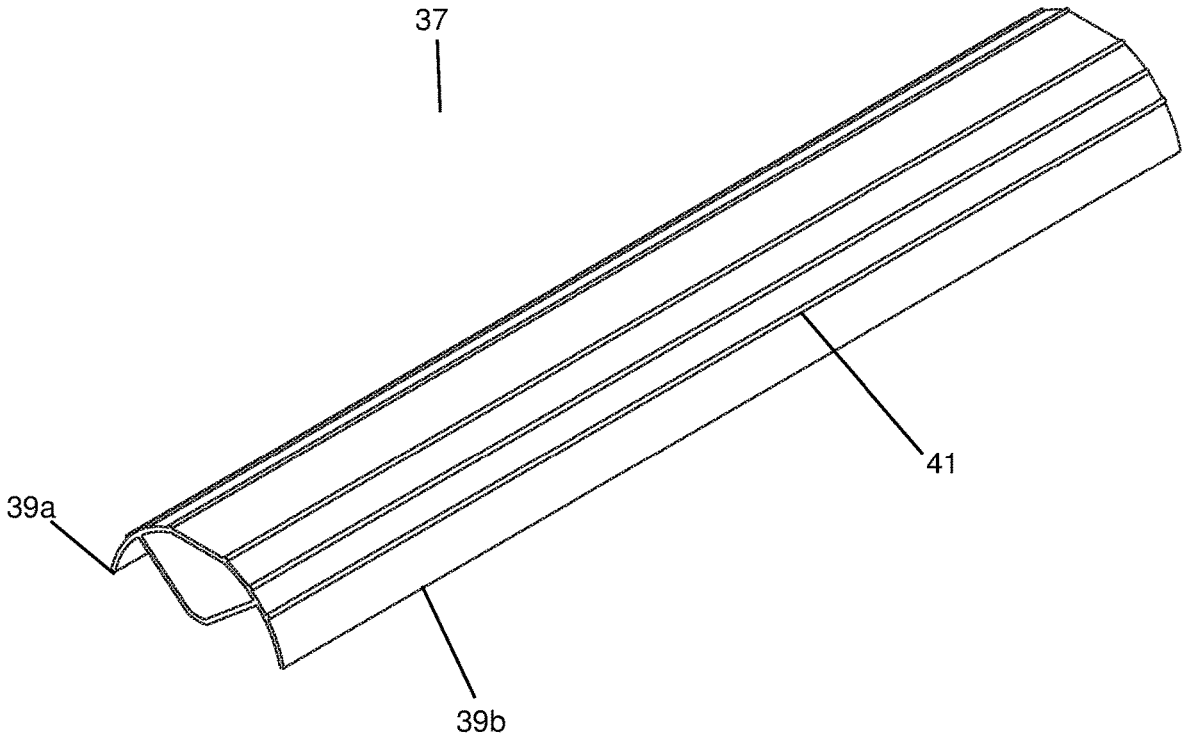
FIG. 4 is a schematic isometric angled side view of an exemplary pedal for the lid opener of FIG. 1.
Figure 5:
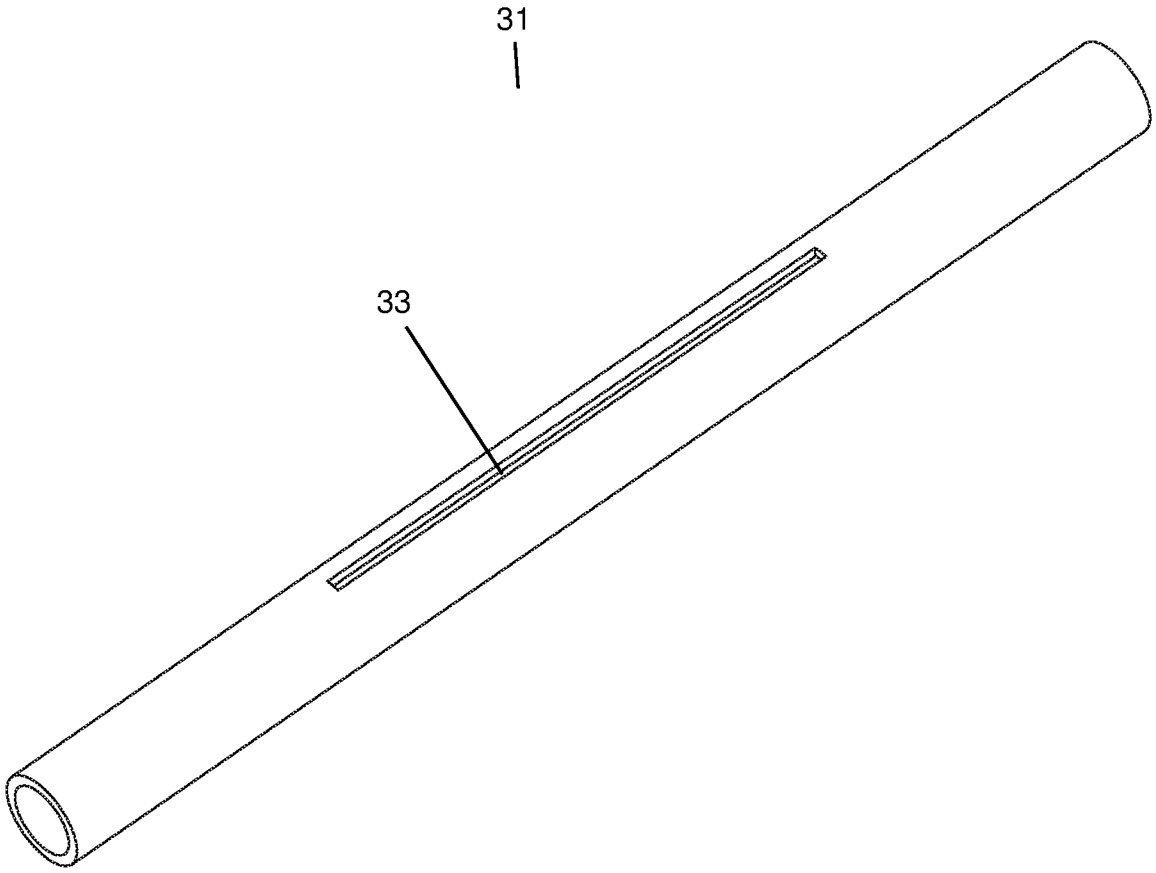
FIG. 5 is a schematic isometric angled side view of an exemplary stabilizer for the lid opener of FIG. 1.
Figure 6:
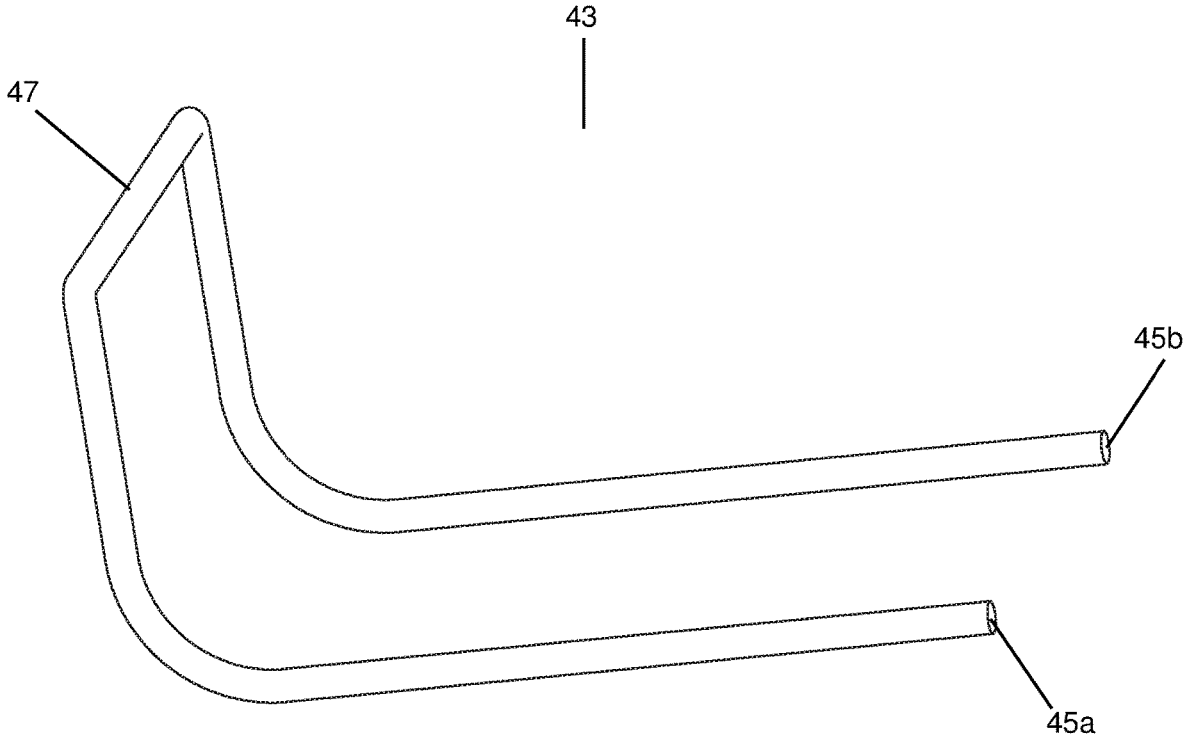
FIG. 6 is a schematic isometric angled side view of an exemplary brace for the lid opener of FIG. 1.
Figure 7:
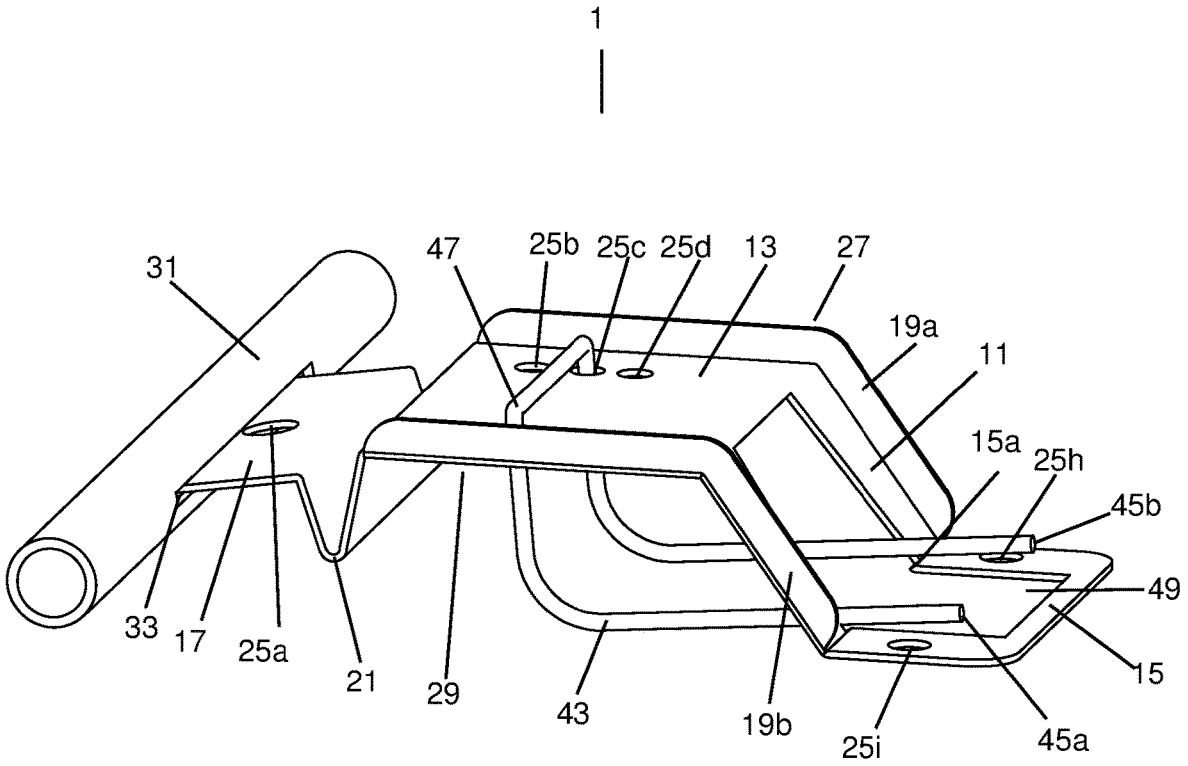
FIG. 7 is a schematic isometric angled side view of the lever of FIG. 1 coupled with the stabilizer of FIG. 5 and the brace of FIG. 6.
Figure 8:
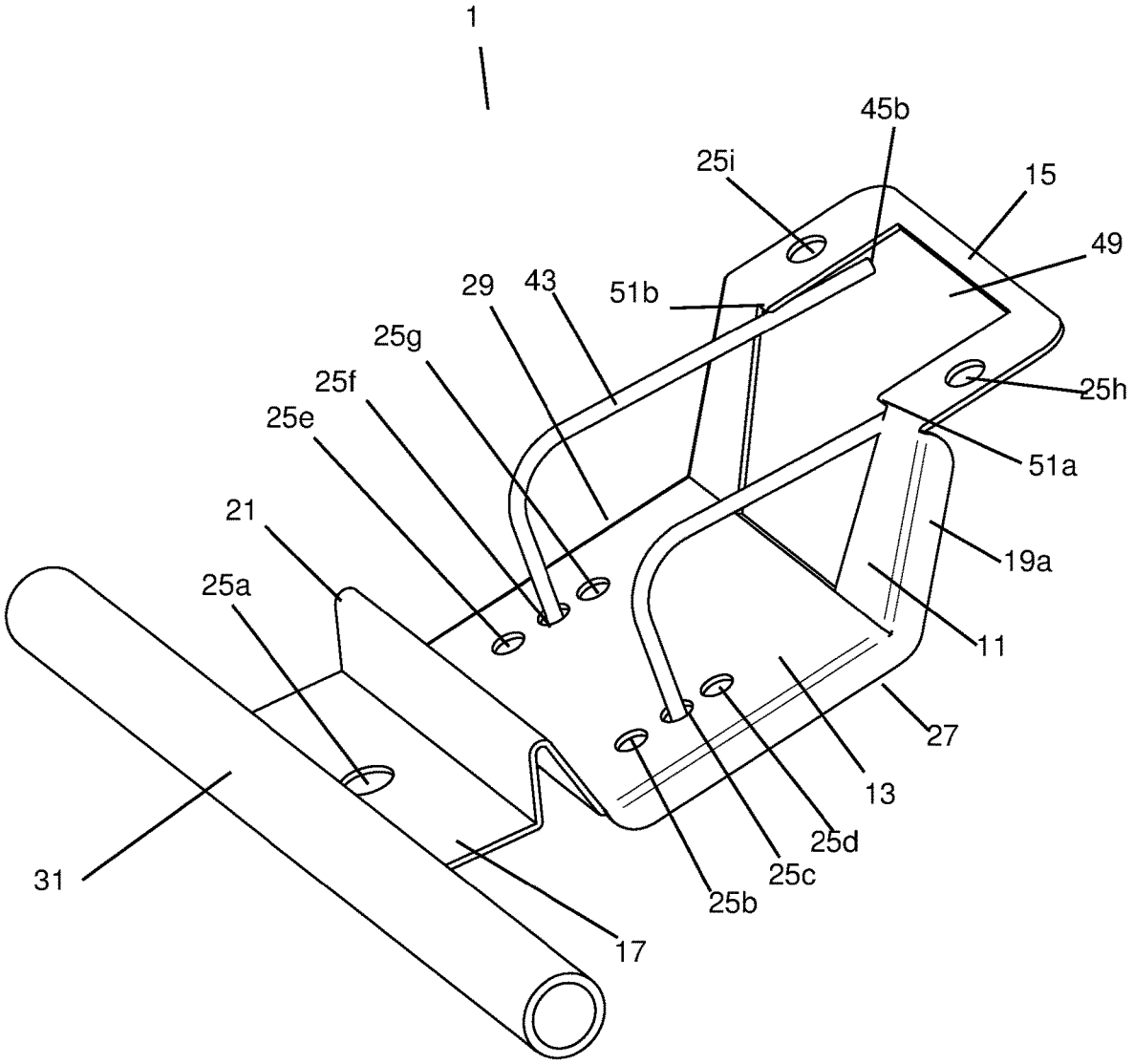
FIG. 8 is a schematic isometric angled bottom view of FIG. 7.
Figure 9:
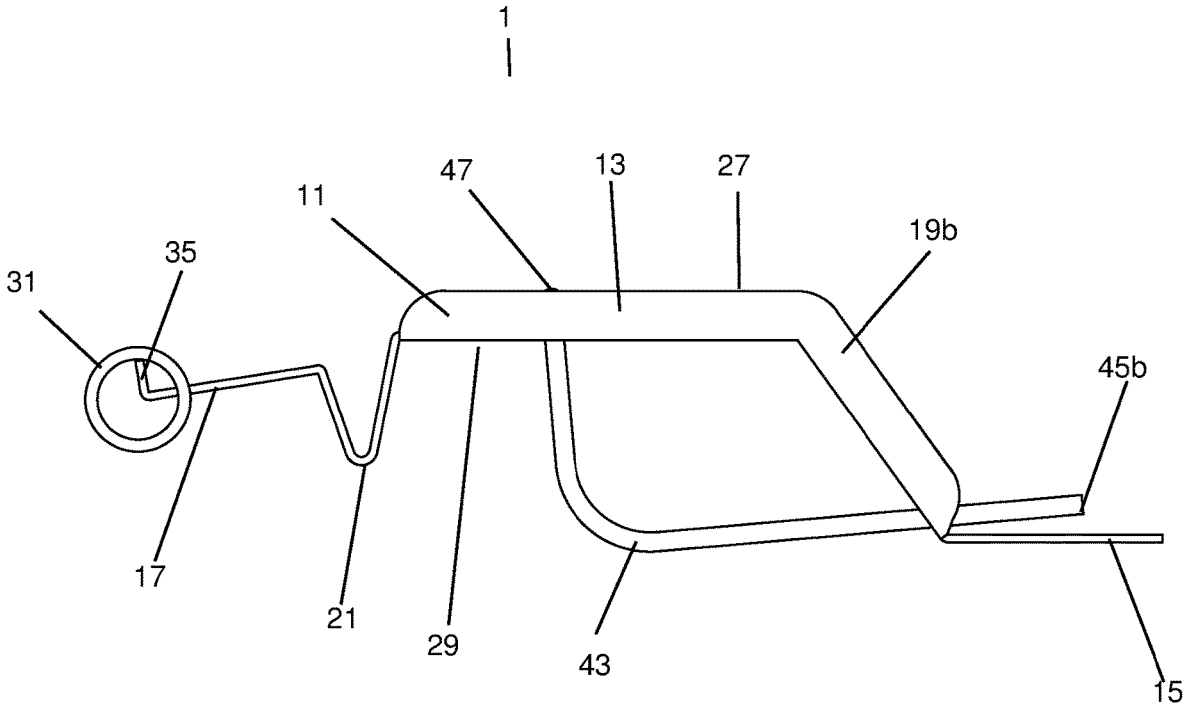
FIG. 9 is a schematic isometric side view of FIG. 7.

The lid opener 1 may further comprise a pedal 37 dimensioned to couple with the cord 23. For example, the pedal 37 may be tubular. Accordingly, the pedal 37 may be coupled with the cord 23 by stringing the cord 23 though the pedal 37 such that a mid section of the cord 23 resides within the pedal 37. The pedal 37 may be dimensioned to rest against the front of the waste container 3 when coupled with the cord 23. As best shown in FIG. 4, for example, the pedal 37 may be dimensioned with two or more extended flat edges 39. As another example, a side of the pedal 37 may be flat. The pedal 37 may further be provided with one or more ridge 41 to provide a gripping surface when force is applied to the pedal 37, for example, by a foot.

The exemplary lid opener 1 may further comprise a brace 43. The brace 43 may be used to secure the lever 11 to the handle 5 of the waste container 3. The brace 43 may be any of a variety of shapes, sizes, and materials. For example, the brace may be a metal wire fashioned into a U shape, with terminating ends 45 of the wire parallel. The brace 43 may further be fashioned to curve upward proximate a non-terminating end 47 of the brace 43. The brace 43 may be coupled with the lever 11 such that the upward curve of the brace 43 enables the brace 43 to extend underneath the handle 5 of the waste container 3 when coupled with the lever 11, with the lever 11 resting on top of the handle 5 of the waste container 3. For example, the brace 43 may be removably coupled with the lever 11 by providing the mid portion 13 of the lever 11 with at least one aperture 25 proximate the first side 27 of the lever 11 aligned with at least one aperture 25 proximate the second side 29 of the lever 11. The brace 43 may accordingly be dimensioned to pass through two of the apertures 25 along the first side 27 and the second side 29 of the mid portion 13 of the lever 11 and underneath the handle 5 of the waste container 3.

At least a portion of the force portion 15 of the lever 11 may be angled downward. Providing an angle to at least a portion of the force portion 15 of the lever 11 serves, in part, to limit the distance the lid 7 of the waste container 3 is able to open with a given amount of applied force, which helps to prevent the lid 7 of the waste container 3 from opening completely and slamming against the back of the waste container 3. Furthermore, by providing the force portion 15 with a downward angle, the terminating ends 45 of the brace 43 may be brought into contact with the lever 11 after passing underneath the handle 5. The terminating ends 45 of the brace 43 may then be coupled with the force portion 15 of the lever 11, securely surrounding the handle 5 of the waste container 3 to hold the lid opener 1 in place.

For example, the force portion 15 of the lever 11 may be provided with a central cavity 49. The central cavity 49 may be a cutout section of the force portion 15, fully or partially enclosed by inner sides of the lever 11. The brace 43 may be dimensioned to extend through the central cavity 49 of the lever 11. The force portion 15 of the brace 43 may further be provided with a catch 51. The catch 51 may, for example, be portions of the lever 11 extending inward from the central cavity 49. The lever 11 and brace 43 may be dimensioned such that, when the brace 43 is coupled with the lever 11, the terminating ends 45 of the brace 43 extend through the central cavity 49 and rest upon the catch 51. In the exemplary embodiment described, tension from rigidity of the brace 43 will secure the brace 43 within the central cavity 49 and against the catch 51. The brace 43 may be coupled and uncoupled with the lever 11 by gently squeezing the terminating ends 47 of the brace 43 together and away from the catch 51. Thus, in the exemplary embodiment, as best shown in FIGS. 7-9 and FIGS. 11-12, the lever 11 may be dimensioned to securely and pivotally couple with the handle 5 of the waste container 3 via the brace 43, by coupling the brace 43 with the lever 11 around the handle 5 of the waste container 3.

The lever 11 and brace 43 may be designed to adjustably couple, thereby adjusting the position of the fulcrum of the lever 11. For example, the lever 11 may be provided with more than one set of apertures 25 along the first side 27 and the second side 29 of the mid portion 13 of the lever 11. Inserting the brace 43 into alternative sets of apertures 25 along the mid portion 13 of the lever 11 allows the lid opener 1 to be attached securely, pivotally, and removably, to a variety of differently dimensioned waste containers. Significantly, adjustable positioning of the brace 43 enables the notch 21 of the lever 11 to be positioned to receive the back edge 9 of the lid 7 of the waste container 3, while still allowing the lever 11, coupled with the brace 43, to be securely attached to the handle 5 of the waste container 3.

With normal use of the exemplary embodiment of FIGS. 1-12, applying an average amount of force to the pedal 37, the lid 7 of the waste container 3 will rise, but will not flip over, allowing the lid 7 to close, due to gravity, when force is no longer applied to the pedal 37. However, if a sufficient amount of force is applied quickly to the pedal 37, the lid 7 of the waste container 3 will flip completely backward. The lid opener 1, unlike other solutions found in the prior art, will restrain, but not completely impede, flipping the lid 7 of the waste container 3. By controlling the amount of force applied to the pedal 37, the lid 7 of the waste container 3 may be opened partially or fully.

In a method of manufacturing the lid opener 1 of the exemplary embodiment of FIGS. 1-12, a lever 11 is formed to pivotally couple with a handle 5 of a waste container 3 with a handle 5 and a lid 7 with a back edge 9. A force portion 15 of the lever 11 is dimensioned to couple with a cord 23. A load portion 17 of the lever 11 is manufactured to extend underneath the lid 7, whereby downward force applied to the cord 23 causes the lever 11 to pivot about the handle 5 and open the lid 7. The load portion 17 of the lever 11 may be manufactured to include a notch 21 dimensioned to receive the back edge 9 of the lid 7. The load portion 17 may also be provided with one or more apertures 25*a* for reasons related to manufacturing of the lever. For example, the one or more apertures 25*a* could be used to hang the lever 11 to dry after painting the lever 11. A brace 43 may be formed to pivotally couple the lever 11 with the handle 5. A pedal 37 may be dimensioned to couple with a mid section of the cord 23. The pedal 37 may further be formed to rest against the front of the waste container 3.

Table of Parts

| | |
|---|---|
| 1 | lid opener |
| 3 | waste container |
| 5 | handle |
| 7 | lid |
| 9 | back edge |
| 11 | lever |
| 13 | mid portion |
| 15 | force portion |
| 17 | load portion |
| 19 | flange |
| 21 | notch |
| 23 | cord |
| 25 | aperture |
| 27 | first side |
| 29 | second side |
| 31 | stabilizer |
| 33 | stabilizer slit |
| 35 | load end flange |
| 37 | pedal |
| 39 | flat edge |
| 41 | ridge |
| 43 | brace |
| 45 | terminating end |
| 47 | non-terminating end |
| 49 | central cavity |
| 51 | catch |

Where in the foregoing description reference has been made to ratios, integers or components having known equivalents then such equivalents are herein incorporated as if individually set forth.

One skilled in the art will appreciate that the first side 27 and the second side 29 are applied herein as identifiers for respective sides of both the lever 11 and discrete elements of the lever 11 to identify the same and their respective surfaces according to their alignment. One skilled in the art will also appreciate that the first side 27 and the second side 29 while mutually exclusive, are interchangeable and imply no particular orientation, which is to say, for example, both the first side 27 and the second side 29 may be either a left side or a right side of the lever 11.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

I claim:

1. A lid opener for interconnection with a waste container with a handle and a lid with a back edge, the lid opener comprising:

a lever dimensioned to pivotally couple with the handle;

a cord coupled with a force portion of the lever;

a load portion of the lever dimensioned to extend underneath the lid;

the lever dimensioned to pivotally couple with the handle via a brace;

a mid portion of the lever provided with at least one aperture proximate a first side of the lever aligned with at least one aperture proximate a second side of the lever;

the force portion provided with a catch; and the brace dimensioned to pass through two of the apertures along the first side and the second side of the mid portion of the lever and removably couple with the catch; whereby downward force applied to the cord causes the lever to pivot about the handle and open the lid.

2. The lid opener of claim 1, wherein the lever is monolithic.

3. The lid opener of claim 1, wherein the lever is provided with a flange dimensioned longitudinally along at least a portion of each side along the length of the lever.

4. The lid opener of claim 1, wherein the load portion is provided with a notch dimensioned to receive the back edge of the lid.

5. The lid opener of claim 1, wherein at least a portion of the force portion of the lever is angled downward.

6. The lid opener of claim 1, wherein length of the cord is adjustable.

7. The lid opener of claim 1, further including a stabilizer coupled with the load portion of the lever.

8. The lid opener of claim 7, wherein the stabilizer is tubular.

9. The lid opener of claim 8, wherein the stabilizer is provided with a stabilizer slit;

the load portion provided with a load end flange; and the stabilizer coupled with the lever via insertion of the load end flange into the stabilizer slit.

10. The lid opener of claim 1, further including a pedal dimensioned to couple with a mid section of the cord;

the cord dimensioned to wrap around the waste container; and the pedal dimensioned to rest against the front of the waste container.

11. The lid opener of claim 10, wherein the pedal is a tube; and the mid section of the cord strung through the pedal.

12. The lid opener claim 1, wherein coupling of the brace with the lever is adjustable.

13. The lid opener of claim 1, wherein the brace is a wire.

14. A method of manufacturing a lid opener for interconnection with a waste container with a handle and a lid with a back edge, comprising the steps of:

forming a lever to pivotally couple with the handle;

dimensioning a force portion of the lever to couple with a cord;

dimensioning a load portion of the lever to extend underneath the lid;

forming a brace dimensioned to pivotally couple the lever with the handle;

providing a mid portion of the lever with at least one aperture proximate a first side of the lever aligned with at least one aperture proximate a second side of the lever;

providing the force portion with a catch; and dimensioning the brace to pass through two of the apertures along the first side and the second side of the mid portion of the lever and removably couple with the catch; whereby downward force applied to the cord causes the lever to pivot about the handle and open the lid.

15. The method of claim 14, further including the step of forming the load portion of the lever with a notch dimensioned to receive the back edge of the lid.

16. The method of claim 14, further including the step of forming a pedal dimensioned to couple with a mid section of the cord; and forming the pedal to rest against the front of the waste container.

17. A lid opener for interconnection with a waste container with a handle and a lid with a back edge, the lid opener comprising:

a lever;

a brace;

a cord;

a pedal;

the lever dimensioned to pivotally couple with the handle via the brace;

a load portion of the lever dimensioned to extend underneath the lid;

the load portion provided with a notch dimensioned to receive the back edge of the lid;

a force portion of the lever coupled with a first end and a second end of the cord;

the pedal coupled with a mid section of the cord;

a mid portion of the lever provided with at least one aperture proximate a first side of the lever aligned with at least one aperture proximate a second side of the lever;

the force portion provided with a catch; and the brace dimensioned to pass through two of the apertures along the first side and the second side of the mid portion of the lever and removably couple with the catch;

whereby downward force applied to the pedal causes the lever to pivot about the handle and open the lid.

* * * * *